United States Patent [19]

Rodondi et al.

[11] 4,186,989

[45] Feb. 5, 1980

[54] FEMALE TERMINAL FOR PRINTED CIRCUITS

[75] Inventors: Andrew F. Rodondi, Sharpsville, Pa.; Alfred V. Rossi, Cortland, Ohio

[73] Assignee: General Motors Corporation, Detroit, Mich.

[21] Appl. No.: 960,581

[22] Filed: Nov. 13, 1978

[51] Int. Cl.[2] ..... H01R 13/12

[52] U.S. Cl. ..... 339/258 R; 339/176 MF

[58] Field of Search ..... 339/17 C, 17 F, 97 C, 339/176 MF, 258 R, 258 P

[56] References Cited

U.S. PATENT DOCUMENTS

| | | | |
|---|---|---|---|
| 2,166,897 | 7/1939 | Wagstaff | 339/258 P |
| 2,972,727 | 10/1971 | Sheller | 339/17 C |
| 3,107,965 | 10/1963 | Solorow et al. | 339/258 R |
| 3,613,043 | 2/1961 | Flanagan, Jr. et al. | 339/17 |
| 4,002,393 | 1/1977 | Merry et al. | 339/97 C |

FOREIGN PATENT DOCUMENTS

| | | | |
|---|---|---|---|
| 816694 | 7/1959 | United Kingdom | 339/17 C |

*Primary Examiner*—Joseph H. McGlynn
*Attorney, Agent, or Firm*—F. J. Fodale

[57] ABSTRACT

A female terminal of unitary sheet metal construction is attached to a flexible printed circuit by crimped tabs at the outer edges of a pair of lateral mounting flanges. The flanges are prevented from being spread apart during terminal use by a clamping arrangement on upright posts connecting the ends of the flanges. The female contact portion is provided by spring blades which accept a mating blade from either side and spread without effecting the portions securing the terminal to the flexible printed circuit.

2 Claims, 5 Drawing Figures

FEMALE TERMINAL FOR PRINTED CIRCUITS

This invention relates generally to electric terminals and, more particularly, to one-piece sheet metal female terminals for printed circuits.

One-piece sheet metal female terminals for printed circuits comprising a U-shaped body with lateral mounting flanges at the free ends of the U-shaped body are already known. These known female terminals are generally attached to the printed circuit by a crimping operation which firmly seats the mounting flanges on the printed circuit next to a slot through the conductor strip and insulation of the printed circuit. In some instances, crimp tabs are used which require additional cooperating slots through the printed circuit. See for instance U.S. Pat. No. 3,613,043 granted to Wilfred Richard Scheller and Winfield Warren Loose, Oct. 12, 1971, for a "Printed Circuit Board Connector" and U.S. Pat. No. 2,972,727 granted to William H. Flanagan, Jr. and Robert W. Fraser, Feb. 21, 1961, for a "Printed Circuit Assembly".

In the known female terminal designs exemplified by the aforementioned patents, the mounting flanges at the free ends of the U-shaped body have a tendency to spread apart when a blade terminal is inserted in the female contact portion of the terminal. This characteristic is undesirable in flexible printed circuit applications, particularly in connection with flexible printed circuits having thin copper conductor strips, as the terminal tends to work loose in use and tear the copper conductor strip.

Broadly, the object of this invention is to provide a one-piece sheet metal female terminal which can be securely fastened to a flexible printed circuit having thin conductor strips of copper or the like and remain securely fastened in use.

Another object of this invention is to provide a one-piece sheet metal female terminal for a flexible printed circuit having portions securing the terminal to the printed circuit and a female contact portion each of which is substantially unaffected by movements of the other.

Yet another object of this invention is to provide a one-piece sheet metal female terminal for a flexible printed circuit which has clamping means which prevent the mounting flanges of the terminal from spreading apart.

Other objects and features of the invention will become apparent to those skilled in the art as the disclosure is made in the following detailed description of a preferred embodiment of the invention as illustrated in the accompanying sheet of drawing in which.

Figure 1:
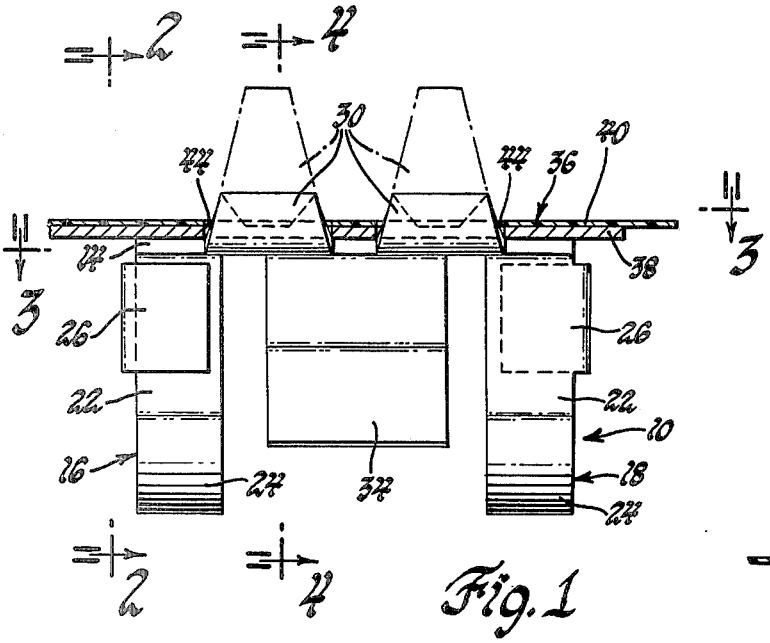
FIG. 1 is a front view of a female terminal of this invention attached to a flexible printed circuit shown in section.
Figure 2:
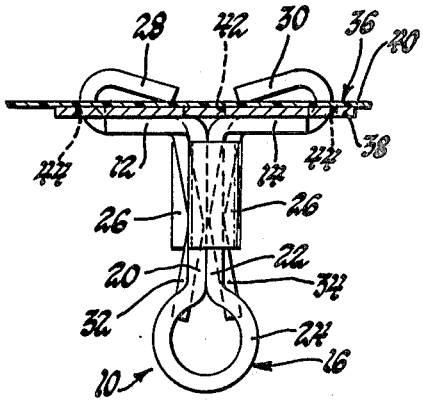
FIG. 2 is a section taken substantially along the line 2—2 of FIG. 1 looking in the direction of the arrows.
Figure 3:
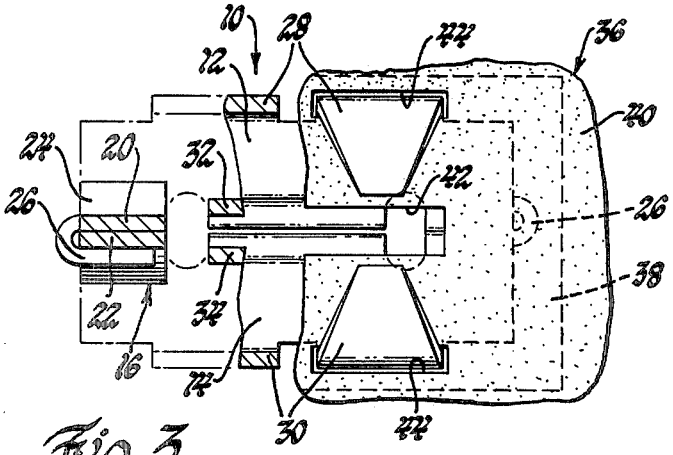
FIG. 3 is a section taken substantially along the line 3—3 of FIG. 1 looking in the direction of the arrows.

Referring now to the drawing, the female terminal 10 is of unitary sheet metal construction and comprises a pair of lateral mounting flanges 12 and 14. The longitudinal edges at each end of the mounting flanges 12 and 14 are connected by integral upright posts 16 ad 18. Each post comprises a pair of flat legs 20 and 22 connected at one end to the respective flanges 12 and 14 and to each other by a reverse bend 24 at the opposite end. Leg 20 of the post 16 has a tab 26 which is bent over the leg 22 to clamp the legs together adjacent the flanges 12 and 14. The post 18 has an opposite arrangement in that the tab 26 is integral with the leg 22 and clamps the leg 20.

The mounting flange 12 has a pair of depending crimp tabs 28 at its outer longitudinal edge and the mounting flange 14 has a corresponding pair of crimp tabs 30. p The female contact portion of the terminal comprises spring blades 32 and 34 which are integrally connected to the mounting flanges 12 and 14, respectively. The spring blades 32 and 34 are midway between the posts 16 and 18 and longitudinally spaced from the posts 16 and 18 at each end. Furthermore, the spring blades 32 and 34 are joined to median longitudinal edge portions of the mounting flanges 12 and 14 which lie in the plane of the mounting flanges 12 and 14 and which are laterally spaced from their respective longitudinal edges at each end connected to the posts 16 and 18. The spring blades 32 and 34 first converge toward each other and then diverge away from each other as they progress from the mounting flanges. Thus the female contact portion formed by the spring blades 32 and 34 accepts a male blade from either direction.

Figure 4:
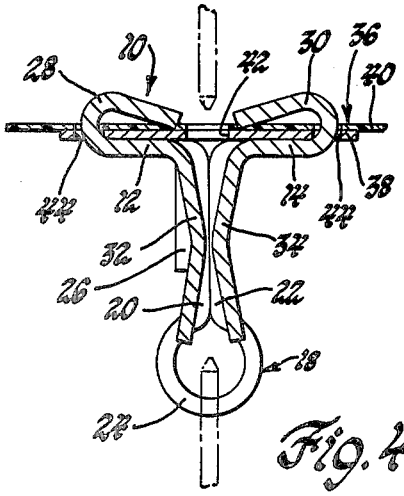
FIG. 4 is a section taken substantially along the line 4—4 of FIG. 1 looking in the direction of the arrows.
Figure 5:
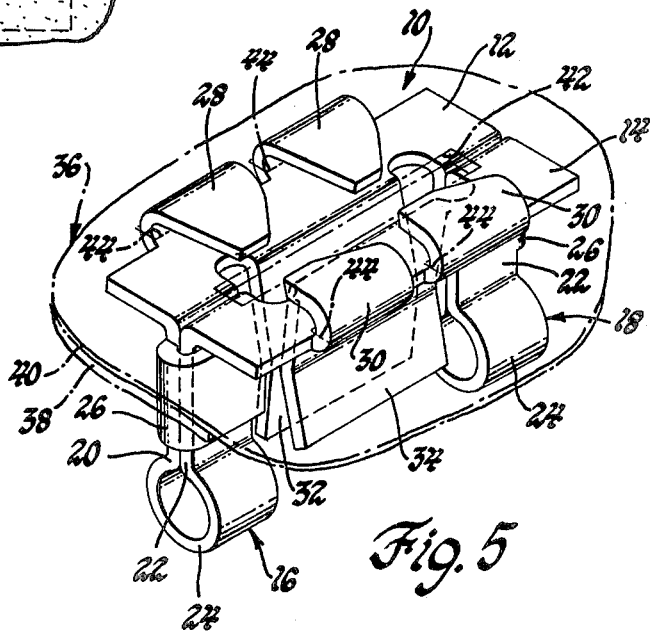
FIG. 5 is a perspective view of the terminal shown in FIG. 1 attached to a printed circuit shown in phantom.

The terminal 10 is attached to a flexible printed circuit 36 which in this particular instance is represented by a conductive strip 38 of copper bonded to a plastic insulating sheet 40 of Mylar, which is a polyester polymer. The flexible printed circuit 36 has a blade slot 42 and four tab slots 44. The terminal 10 is assembled to the flexible printed circuit by inserting the tabs 28 and 30 through the slots 44 until the mounting flanges 12 engage the flexible printed circuit 36. The tabs 28 and 30 are then crimped to secure the terminal 10 to the flexible printed circuit 36. When crimped, the sharp corners of the tabs 28 and 30 pierce the Mylar sheet 40 and bite into the conductor strip 38 to establish electric contact. Consequently the terminal 10 may be assembled to either side of the flexible printed circuit 36 or used with flexible printed circuits having insulating sheets on both sides of the conductor strips. Once attached, the terminal 10 can accept a blade terminal from either end as shown in FIG. 4. Moreover, the terminal 10 remains firmly attached to the flexible printed circuit 36 after repeated use because the mounting flanges 12 and 14 are prevented from spreading apart by the tabs 26 which clamp the posts 20 and 22 together adjacent the mounting flanges 12 and 14. The mounting flanges 12 and 14 and cooperating crimp tabs 28 and 30 which secure the terminal 10 to the flexible printed circuit 36 are thus substantially unaffected by movements of the spring blades 32 and 34. On the other hand, the spring blades 32 and 34 (particularly the preset gap between them) are substantially unaffected by movement of deformation of the crimp tabs when the terminal 10 is secured to the flexible printed circuit 36. The securing arrangement obviously accommodates printed circuits of various thicknesses. However, the terminal 10 is especially well suited for moderately thin to very thin flexible printed circuits having overall thicknesses ranging from 0.0158 inches (one ounce copper which is 0.0015 inch thick plus two Mylar sheets each 0.003 inch thick) to 0.0035 inches (seven ounce copper which is 0.0098 inch thick plus one Mylar sheet 0.002 inch thick).

We wish it to be understood that we do not desire to be limited to the exact details of construction shown and described, for obvious modifications will occur to a person skilled in the art.

The embodiments of the invention in which an exclusive property or privilege is claimed are defined as follows:

1. In a unitary sheet metal female terminal having a pair of lateral mounting flanges adapted for attaching the mounting flanges to a flexible printed circuit and a resilient, laterally spreadable female contact portion joined to laterally spaced, longitudinal edge portions of the respective mounting flanges; the improvement comprising:

said laterally spaced mounting flanges having adjacent longitudinal end edge portions which are laterally spaced from the longitudinal edge portions joined to the female contact portion, and a pair of longitudinally spaced upright posts joined to the longitudinal end edge portions, each post comprising a pair of flat leg portions joined to a respective mounting flange and clamped together adjacent the mounting flanges by an integral tab of one of said leg portions which is wrapped over the other of said leg portions to prevent the mounting flanges from spreading apart when the female contact portion is laterally spread upon receipt of a mating blade terminal therein.

2. In a unitary sheet metal female terminal having a pair of lateral mounting flanges with depending crimp tabs for attaching the mounting flanges to a flexible printed circuit and an upright, resilient, laterally spreadable female contact portion joined to laterally spaced, longitudinal edge portions of the respective mounting flanges; the improvement comprising:

said female contact portion comprising a pair of laterally spaced spring blades which are joined to respective ones of the laterally spaced longitudinal edge portions and which are spreadable for biased engagement with a mating blade terminal disposed therebetween, said laterally spaced mounting flanges having adjacent longitudinal end edge portions which are laterally spaced from the longitudinal edge portions joined to the spring blades, and a pair of longitudinally spaced upright posts joined to the longitudinal end edge portions, each post comprising a pair of flat leg portions joined to a respective mounting flange and clamped together adjacent the mounting flanges by an integral tab of one of said leg portions which is wrapped over the other of said leg portions to prevent the mounting flanges from spreading apart when the spring blades are spread upon receipt of a mating blade terminal therebetween.

* * * * *

UNITED STATES PATENT AND TRADEMARK OFFICE

CERTIFICATE OF CORRECTION

PATENT NO. : 4,186,989

DATED : February 5, 1980

INVENTOR(S) : Andrew F. Rodondi & Alfred V. Rossi

It is certified that error appears in the above-identified patent and that said Letters Patent are hereby corrected as shown below:

Col. 2, line 2, "ad" should read -- and --;

Col. 2, line 14, delete "p" after "tabs 30." and begin a new paragraph with "The female";

Col. 2, line 67, "one" should read -- seven --;

Col. 2, line 67, "0.0015 inch" should read -- .0098 inch --;

Col. 3, line 1, "seven" should read -- one --;

Col. 3, line 1, "0.0098 inch" should read -- .0015 inch --.

Signed and Sealed this

*Third* Day of *June 1980*

[SEAL]

*Attest:*

SIDNEY A. DIAMOND

*Attesting Officer*

*Commissioner of Patents and Trademarks*